US006968710B1

(12) United States Patent
Kozinski

(10) Patent No.: US 6,968,710 B1
(45) Date of Patent: Nov. 29, 2005

(54) REFRIGERATION COMPRESSOR CAPACITY LIMITING DEVICE

(76) Inventor: Richard C. Kozinski, 27671 Dowland, Warren, MI (US) 48092

( * ) Notice: Subject to any disclaimer, the term of this patent is extended or adjusted under 35 U.S.C. 154(b) by 36 days.

(21) Appl. No.: 10/397,393

(22) Filed: Mar. 26, 2003

Related U.S. Application Data

(60) Provisional application No. 60/368,059, filed on Mar. 26, 2002.

(51) Int. Cl.[7] ..... F25D 19/00
(52) U.S. Cl. ..... 62/296; 181/241
(58) Field of Search ..... 62/296, 324.6; 138/43, 45, 46; 181/229, 241

(56) References Cited

U.S. PATENT DOCUMENTS

| | | | | |
|---|---|---|---|---|
| 3,848,858 | A * | 11/1974 | Page et al. | 261/63 |
| 4,592,349 | A * | 6/1986 | Bird | 128/204.25 |
| 5,335,459 | A * | 8/1994 | Dale | 451/102 |
| 5,576,495 | A * | 11/1996 | Vetterick | 73/861.04 |
| 5,820,102 | A * | 10/1998 | Borland | 251/144 |
| 5,821,475 | A * | 10/1998 | Morehead et al. | 181/255 |
| 5,880,378 | A * | 3/1999 | Behring, II | 73/861.53 |
| 6,065,486 | A * | 5/2000 | Vetterick et al. | 137/171 |
| 6,065,691 | A * | 5/2000 | West | 239/407 |
| 6,089,274 | A * | 7/2000 | Fan | 138/31 |
| 6,431,294 | B1 * | 8/2002 | Eddison et al. | 175/415 |
| 6,478,958 | B1 * | 11/2002 | Beard et al. | 210/323.2 |
| 6,595,203 | B1 * | 7/2003 | Bird | 128/200.21 |

FOREIGN PATENT DOCUMENTS

| | | | |
|---|---|---|---|
| EP | 1069304 | A2 * | 1/2001 |
| JP | 407147713 | A * | 6/1995 |

* cited by examiner

*Primary Examiner*—William Doerrler
*Assistant Examiner*—Mohammad M. Ali
(74) *Attorney, Agent, or Firm*—Rader, Fishman & Grauer PLLC

(57) ABSTRACT

A sonic nozzle is disclosed that is positioned between an evaporator and compressor in an air conditioning system. The sonic nozzle limits refrigerant flow rate to that allowed by sonic velocity at a throat area of the sonic nozzle. The sonic nozzle may have a by-pass flow area that allows for less pressure drop at lower flow rates where the by-pass flow area is sealed off at a predetermined pressure drop to force all flow through the sonic nozzle. Another embodiment that is disclosed features a thermally actuated suction throttling valve that is attached to a sonic nozzle. A power element of the throttling valve contains thermally active fluid, such as water, when frozen activates a piston member into the throat portion of the sonic nozzle to restrict fluid flow.

4 Claims, 4 Drawing Sheets

REFRIGERATION COMPRESSOR CAPACITY LIMITING DEVICE

RELATED APPLICATIONS

This application claims priority to U.S. Provisional Application No. 60/368,059 filed Mar. 26, 2002, the contents of which is incorporated herein in its entirety.

FIELD OF THE INVENTION

The present invention relates generally to vapor compression refrigeration systems that utilize a fixed a variable restrictor for flow control. More particularly, the present invention relates to vapor compression refrigeration systems for automotive systems that use a compressor that varies capacity with engine speed.

BACKGROUND OF THE INVENTION

Automotive and light commercial air conditioning systems generally use either a piston type or a scroll compressor. In operation, the scroll compressor differs from the piston compressor in that the volumetric efficiency of the scroll compressor goes up as rotational speed is increased while the volumetric efficiency of the piston compressor goes down as rotational speed is increased. Accordingly, the scroll compressor produces very high head pressures when a vehicle is accelerated in hot ambient temperature. Thus, the high side pressure switch may trip, causing system cooling performance to suffer.

While the piston compressor may produce 30,000 BTU/hr at high rotational speeds, the scroll compressor may produce 50,000 BTU/hr. Air conditioning systems that incorporate a suction accumulator aggravate the challenges with the scroll compressors due to violent boiling of the accumulator refrigerant when suction pressure is suddenly dropped by the scroll pumping capacity on acceleration of the vehicle. This results a greater mass flow rate to the compressor as compared to a thermostatic expansion valve system with no accumulator. While a suction throttling valve may solve this problem, most are cost prohibited and complex to install.

Sonic nozzles have been used for years in fluid flow measurement. At flow rates below sonic, the nozzle can recover up to 94% of pressure loss. In comparison, a square edge orifice recovers only 12% of pressure loss. Pressure recovery is essential as each 1.0 psi drop in suction plumbing reduces capacity by approximately 1%. A ¼ inch diameter square edged orifice may produce a 7 psi drop at a given flow rate while the sonic nozzle may be 1 psi at similar flow and throat size.

SUMMARY OF THE INVENTION

A sonic nozzle for use in air conditioning and refrigeration systems is disclosed. In a first embodiment, the sonic nozzle of the present invention includes a first opening having a first predetermined diameter, a second opening having a second predetermined diameter, an aperture extending through the first and second openings. The aperture further includes a first tapered section and a second tapered section. The first tapered section is positioned adjacent to the first opening and converges inwardly to a throat portion having a third predetermined diameter. The first tapered section converges at a first predetermined diameter. The second tapered section diverges from the third predetermined diameter at a second predetermined angle. The second tapered section terminates at the second opening.

In one embodiment, the sonic nozzle is a fixed nozzle. That is, once installed in a fluid conduit or intake valve of a compressor in an air conditioning system, it does not move. To "fix" the nozzle in place, in one embodiment, the outer diameter of the nozzle includes a groove formed in the outer diameter of the nozzle. A seal, such as an O-ring is provided.

In another embodiment, the sonic nozzle is a movable nozzle. In accordance with this aspect of the invention, a sonic nozzle is provided, and a biasing spring is positioned adjacent the second opening of the sonic nozzle to limit the movement of the nozzle when in use. At least one set of spring shoulders, which also serve as guides for the nozzle, are also provided. When there is no or low flow rate of fluid in the conduit of the air conditioning system, fluid is permitted to enter a by-pass flow area around the outer periphery of the nozzle. As flow and pressure drop across the sonic nozzle increases, the biasing spring permits movement of sonic nozzle to seal off the by-pass flow area.

In addition to a pressure actuated sonic nozzle, in accordance with another aspect of the invention, a thermally activated throttling valve is disclosed. The throttling valve assembly is positioned adjacent and secured to the first opening of the sonic valve. The throttling valve includes a power element housing that contains thermally active fluid that acts upon a flexible member to move a throttling piston into the throat portion of the sonic nozzle to restrict fluid flow.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION

Figure 1:
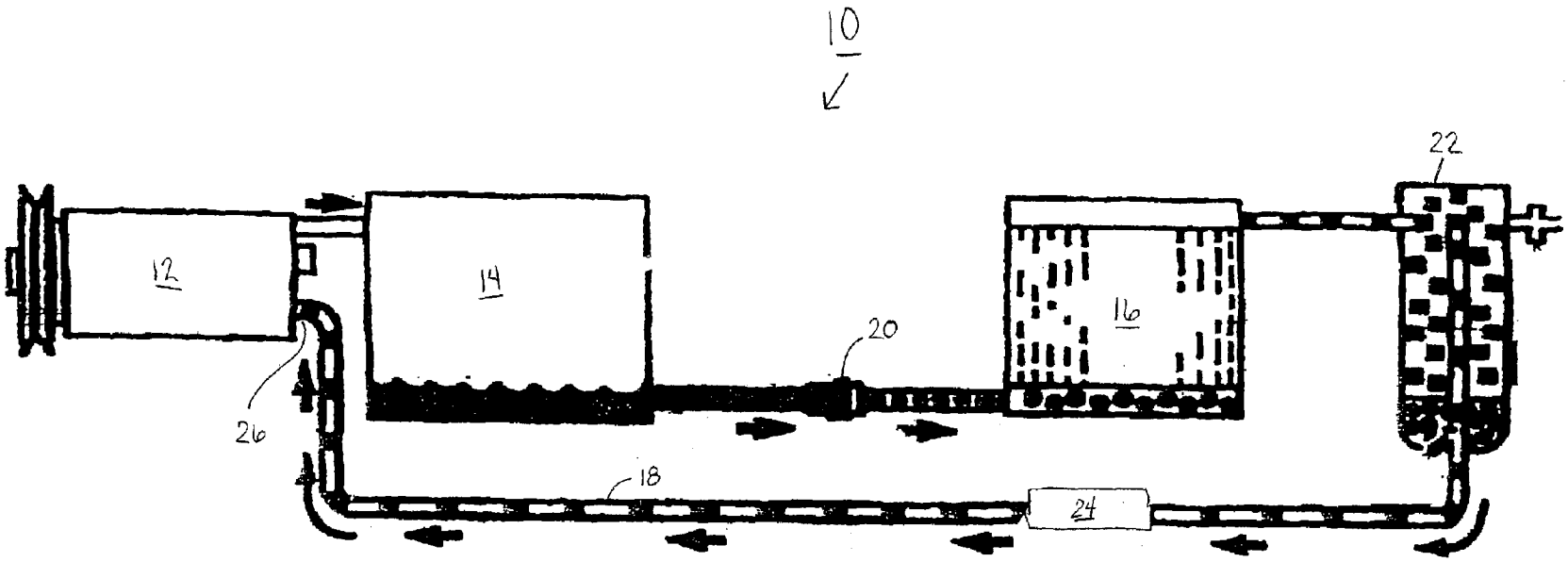
FIG. 1 is a schematic representation of a refrigeration system utilizing a sonic nozzle as a capacity control device in accordance with the present invention.

Turning now to FIGS. 1–3, the details of the present invention will be described. FIG. 1 depicts an automotive air conditioning system 10. System 10 includes a compressor 12, condenser 14, and an evaporator 16. A liquid line conduit 18 connects the compressor 12, condenser 14 and evaporator 16, in series. An expansion tube or orifice 20 may also be included in system 10. Orifice 20 is positioned between condenser 14 and evaporator 16. System 10 may further include an accumulator 22.

In accordance with one aspect of the invention, system 10 includes a sonic nozzle 24. Sonic nozzle 24 is positioned between evaporator 16 or accumulator 22 and compressor 12. Sonic nozzle 24 may be formed in conduit 18, formed as part of a fitting to be added to conduit 18, or as a separate part. Further, sonic nozzle 24 may also be formed in the intake port 26 of compressor 12.

Figure 2B:
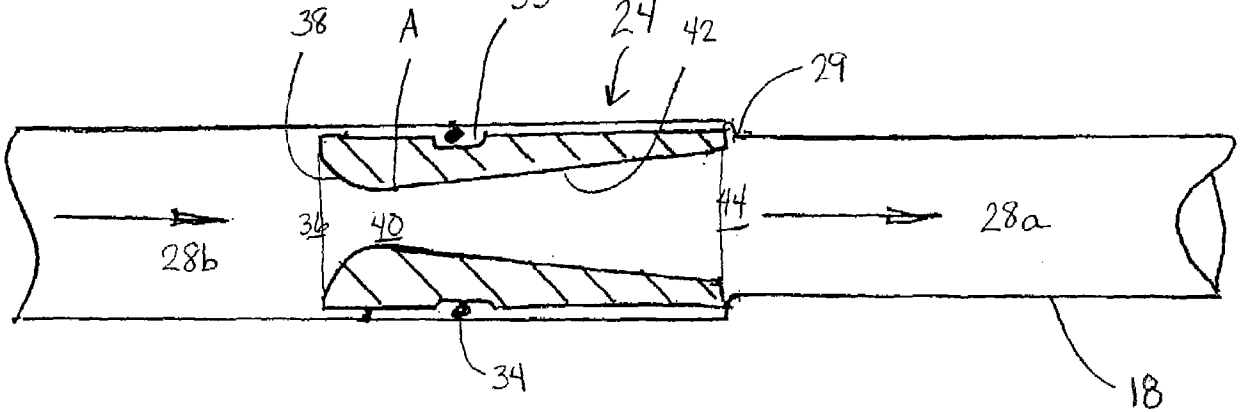
FIG. 2*b* is an elevational view of the sonic nozzle of FIG. 2*a* in accordance with the present invention.
Figure 2A:
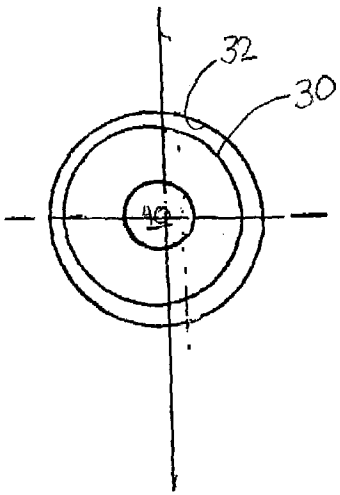
FIG. 2*a* is an end view of a sonic nozzle in accordance with the present invention.

Turning now to FIGS. 2*a*–2*b*, the details of sonic nozzle 24 will be discussed. Sonic nozzle 24 is designed as a separate part that is inserted into conduit 18. In accordance with the invention, conduit 18 includes first and second diameter sections, 28*a*, 28*b*. Second diameter section 28*b* is slightly larger than first diameter section 28*a*, such that a step 29 is formed. Step 29 serves as a stop for securing sonic nozzle 24 within conduit 18.

As seen best in FIG. 2*a*, in one embodiment where sonic nozzle is formed as a separate part, sonic nozzle 24 has an outside diameter 30 that is slightly smaller than an inside diameter 32 of conduit 18. Outside diameter 30 includes a groove or notch 33 formed on the outside surface. Notch 33 has a predetermined depth. A sealing O-ring 34 having a predetermined diameter that is larger than the depth of notch 32 is also provided. When O-ring 34 is positioned in notch 32 and sonic nozzle 24 is secured in conduit 18 against step 29, O-ring 34 serves to secure sonic nozzle 24 in conduit 18.

Sonic nozzle 24 includes a first opening 36 that opens into an inlet portion 38, a throat portion 40, and an outlet portion 42 that diverges into a second opening 44. Second opening 44 may further include a flange portion or lip (not shown) that contacts step 29.

In accordance with the present invention, sonic nozzle 24 has a venturi contour such that first opening 36 opens into inlet portion 38 that converges into throat portion 40. Outlet portion 42 diverges to second opening 44. As can be seen, inlet portion 38 generally has a circular arc that passes through throat portion 40 to a tangent point A. At this point, outlet portion 42 becomes conical. It is preferred that the surface finish of inlet portion 38, throat portion 40 and outlet portion 42 is generally smooth with no irregular defects such as waviness and steps.

Sonic nozzle 24 may be sized to limit the cooling capacity of compressor 12 and thus solve the high head pressure problem of the scroll compressor. With the scroll compressor and other types of compressors 12, sonic nozzle 24 could be used to limit system 10 cooling capacity thus reducing compressor 12 horsepower at certain high load, high speed conditions resulting in improved fuel economy.

In accordance with the invention, under sonic velocity in throat portion 40, sonic nozzle 24 recovers up to 94% of the static pressure drop between inlet portion 38 and throat portion 40. At sonic velocity, fluid flow is limited to sonic of the gas (R-134A refrigerant is 40 ft/sec), regardless of how low downstream pressure drops. Accordingly, a low pressure drop flow control with a defined flow limit that depends on throat flow area, is achieved.

Figure 3B:
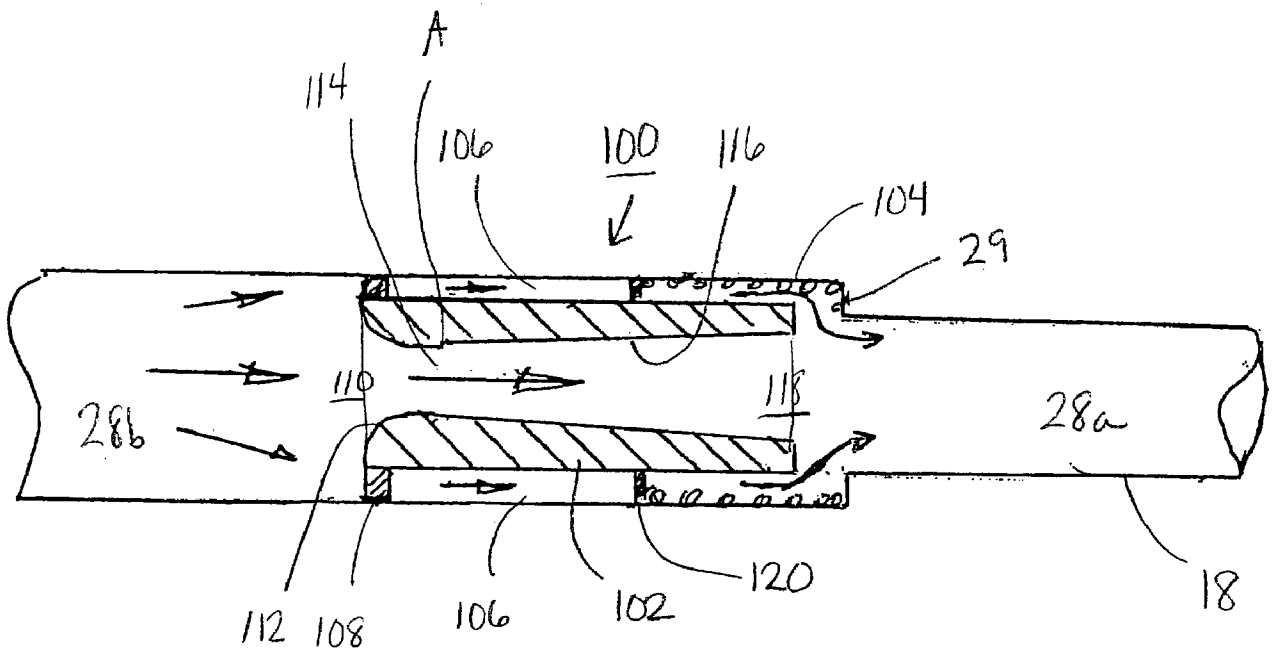
FIG. 3*b* is an elevational view of the sonic nozzle of FIG. 3*a* in accordance with the present invention.
Figure 3A:
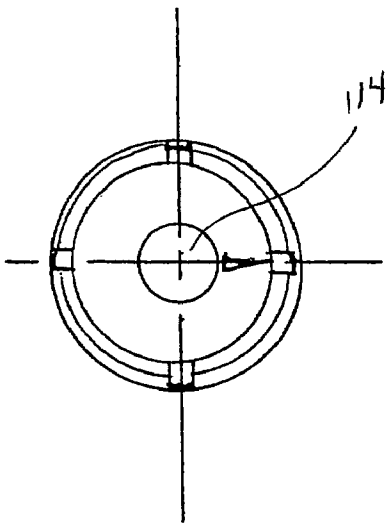
FIG. 3*a* is end view of an alternative embodiment of the sonic nozzle in accordance with the present invention.

An alternative embodiment of the present invention is shown in FIGS. 3*a*–3*b*. More specifically, FIGS. 3*a* and 3*b* illustrate a movable sonic nozzle assembly 100 that includes a sonic nozzle 102, a biasing spring 104, a by-pass flow area 106 and a plurality of guides 108. In accordance with one aspect of the invention, sonic nozzle 100 is shown as a separate unit that is placed in conduit 18 in system 10. Again, conduit 18 has a first diameter section 28*a* and a second diameter section 28*b* such that a step 29 is formed. Step 29 serves as a stop to secure sonic nozzle assembly 100 within conduit 18. Step 29 further serves to limit movement of sonic nozzle 102 and seal by-pass flow area 106, as will be explained in further detail below.

Sonic nozzle 102 includes a first opening 110 that opens into an inlet portion 112, a throat portion 114 connected to inlet portion 112, and an outlet portion 116 that diverges into a second opening 118. In accordance with the present invention, sonic nozzle 102 has a venturi contour such that first opening 110 opens into inlet portion 112 that converges into throat portion 114. Outlet portion 116 diverges to second opening 118. As can be seen, inlet portion 112 generally has a circular arc that passes through throat portion 114 to a tangent point A. At this point, outlet portion 116 becomes conical. It is preferred that the surface finish of inlet portion 112, throat portion 114 and outlet portion 116 is generally smooth with no irregular defects such as waviness and steps.

Sonic nozzle assembly 100 further includes a plurality of spring shoulders 120 that are positioned a predetermined distance upstream of step 29 in second diameter section 28*b* of conduit 18. Biasing spring 104 is positioned between spring shoulders 110 and step 29, and around second opening 118 of sonic nozzle 102. Guides 108 are provided within second section 28*b* of conduit 18, adjacent first opening 110 of sonic nozzle. Guides 108 and spring shoulders 120 cooperate to maintain the proper orientation of sonic nozzle 102 during operation.

During operation, at no or low flow of fluid in conduit 18, fluid is able to enter by-pass flow are 106, as is shown in FIG. 3*b*. As flow and pressure drop across sonic nozzle 102 is increased, biasing spring 104 permits movement of sonic nozzle 102. Due to the movability of sonic nozzle 102, a lower pressure drop at low flow conditions, such as at idle conditions, may be achieved. Moreover, at higher flow rates, the flow capacity may be limited to a lower value by engagement of an outer periphery 122 of second opening 118 to step 29, thereby sealing off by-pass flow area 106 and limiting flow area to the venturi shaped passage of sonic nozzle 102.

Figure 4B:
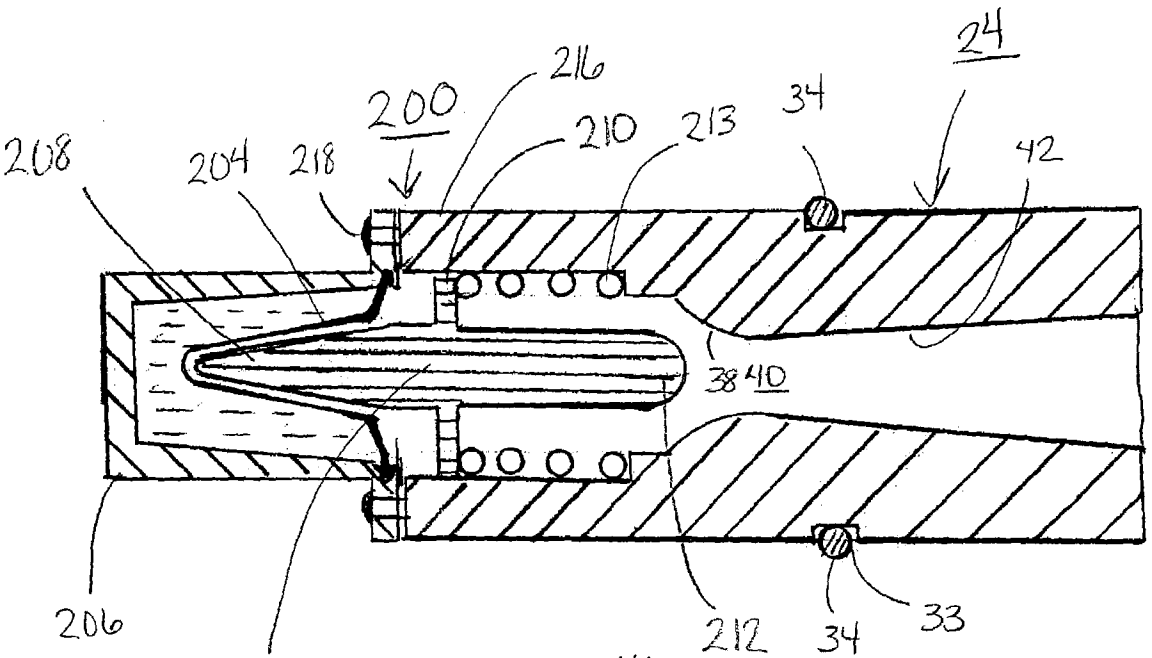
FIG. 4*b* is an elevational view of the thermally actuated suction throttle valve in accordance with the present invention.
Figure 4A:
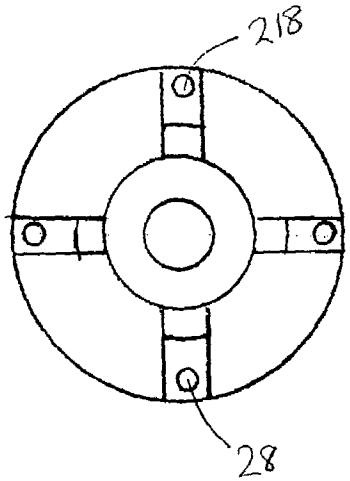
FIG. 4*a* is an end view of a thermally actuated suction throttling valve attached to the sonic nozzle of the present invention.

FIGS. 4*a* and 4*b* illustrate an alternative embodiment of a thermally actuated suction throttling valve 200 that is attached to sonic nozzle 24. In accordance with one aspect of the invention, throttling valve 200 includes a throttling piston 202, a flexible membrane 204, and a power element housing 206. Throttling piston 202 includes an actuation end 208, a flange member 210, a sealing end 212, and a spring 213. Flexible membrane 204 is positioned around actuation end 208 of throttling piston 202. Power element housing 206 is secured to a distal end 214 of a housing 216 for sonic nozzle 24. In one embodiment, power element housing 206 is attached to distal end 214 via attachment pins 218, although it is understood that any suitable means for attaching power element housing 206 may be employed.

In accordance with one aspect of the invention, deposited within power element housing 206 and outside of flexible membrane 204 is a fluid such as water (possibly with additives therein) which, when frozen, expands and deforms flexible membrane 204 around actuation end 208. Flexible membrane 204 thereby acts upon actuation end 208 of throttling piston 202, thereby forcing piston 202 to act against spring 213 and forcing sealing end 212 of throttling piston 202 through first opening 36 and inlet portion 38, into throat portion 40, thereby restricting flow through sonic nozzle 24 when the temperature of the fluid in conduit 18 upstream of sonic nozzle 24 falls to a predetermined level.

The advantages associated with employing a suction throttling device include a reduction in compressor clutch cycle frequency resulting in colder, more stable, evaporator discharge air temperatures. Sonic nozzles that are temperature actuated have advantages over pressure actuated valves due to a time delay that is beneficial in certain driving conditions with an automotive orifice type air conditioning system.

Preferred embodiments of the present invention have been disclosed. A person of ordinary skill in the art would realize, however, that certain modifications would come within the teachings of this invention. Therefore, the following claims should be studied to determine the true scope and content of the invention.

What is claimed is:

1. A sonic nozzle assembly for use in refrigeration systems, comprising:

a conduit;

a selectively movable sonic nozzle having:

a body portion defined by a first opening on one end of said body portion and a second opening on an opposite end of said body portion;

said first opening having a first predetermined diameter;

said second opening having a second predetermined diameter;

an aperture extending through said body portion and connecting said first opening to said second opening;

wherein said aperture has a first tapered section and a second tapered section and said first tapered section has a shorter length than said second tapered section;

said first tapered section positioned adjacent to said first opening and converging inwardly to a throat portion having a third predetermined diameter at a first predetermined angle;

said second tapered section diverging from said third predetermined diameter at a second predetermined angle said second predetermined diameter that terminates at said second opening;

a by-pass flow area formed between an outer diameter of said sonic nozzle and an inner diameter of said conduit in which said sonic nozzle is placed such that said nozzle may selectively move relative to said conduit in response to a predetermined pressure drop;

a biasing spring positioned adjacent said second opening of said sonic nozzle and cooperating with said sonic nozzle to limit movement of said sonic nozzle when in use; and at least one spring shoulder positioned within said conduit to retain said biasing spring under tension;

the spring biases the sonic nozzle to by-pass the flow of refrigerant through the by-pass flow area.

2. The sonic nozzle assembly of claim 1, further including at least two guides positioned adjacent said first opening.

3. The sonic nozzle assembly of claim 1, wherein said second opening has an engagement surface that cooperates with a step formed in a conduit when said sonic nozzle is in use.

4. The sonic nozzle of claim 3, wherein said engagement surface includes a substantially planar flange that is generally horizontal.

* * * * *